US010037848B2

(12) United States Patent
Lange et al.

(10) Patent No.: US 10,037,848 B2
(45) Date of Patent: Jul. 31, 2018

(54) INDUCTIVE ROTARY TRANSMITTER

(71) Applicant: Carl Mahr Holding GmbH, Göttingen (DE)

(72) Inventors: Andreas Lange, Gleichen-Reinhausen (DE); Matthias Ringleb, Uder (DE); Maik Wieland, Rosdorf (DE)

(73) Assignee: Carl Mahr Holding GmbH, Göttingen (DE)

( * ) Notice: Subject to any disclaimer, the term of this patent is extended or adjusted under 35 U.S.C. 154(b) by 0 days.

(21) Appl. No.: 14/991,558

(22) Filed: Jan. 8, 2016

(65) Prior Publication Data

US 2016/0203906 A1 Jul. 14, 2016

(30) Foreign Application Priority Data

Jan. 9, 2015 (DE) ..... 10 2015 100 233

(51) Int. Cl.
*H01F 38/18* (2006.01)
*H01F 27/24* (2006.01)

(52) U.S. Cl.
CPC ..... *H01F 38/18* (2013.01); *H01F 27/24* (2013.01)

(58) Field of Classification Search
CPC ..... H01F 38/18
USPC ..... 336/12.15, 49.02, 49.22
See application file for complete search history.

(56) References Cited

U.S. PATENT DOCUMENTS 3,229,202 A * 1/1966 Wenk ..... G01P 3/49 310/40 R
3,611,230 A * 10/1971 Maake ..... H01F 38/18 336/120
3,612,995 A * 10/1971 Leufgen ..... H01F 38/18 324/200

(Continued)

FOREIGN PATENT DOCUMENTS

DE 2657813 A1 9/1977
DE 10107577 A1 9/2002

(Continued)

OTHER PUBLICATIONS

Search report in corresponding British application No. GB1523070.9, dated Mar. 9, 2016, 4 pages.

(Continued)

*Primary Examiner* — Elvin G Enad
*Assistant Examiner* — Malcolm Barnes
(74) *Attorney, Agent, or Firm* — Fitch, Even, Tabin & Flannery LLP

(57) ABSTRACT

An inductive rotary transmitter includes a rotor and a stator, which form a rotary transmitter. A rotor winding is arranged on the rotor, and a stator winding is arranged on the stator. Apart from the rotor winding, the rotor does not have any ferromagnetic or soft-magnetic material parts for inductive coupling to the stator or the stator winding. The annularly closed magnetic field lines for inductive coupling are formed on the stator side via the stator winding and a plurality of separate stator elements, which are produced from ferromagnetic or soft-magnetic material. The stator elements overlap both the rotor winding and the stator winding at a respective mounting point of the stator element and direct the magnetic field lines (M) around the rotor winding and around the stator winding to effect a magnetic coupling.

18 Claims, 8 Drawing Sheets

(56) References Cited

U.S. PATENT DOCUMENTS

| | | | | |
|---|---|---|---|---|
| 4,096,535 | A | 6/1978 | Highnote | |
| 4,610,168 | A * | 9/1986 | Morgan | H01F 38/18 336/120 |
| 4,741,217 | A * | 5/1988 | Morgan | G01L 3/108 336/120 |
| 5,293,308 | A * | 3/1994 | Boys | H02J 5/005 324/392 |
| 6,005,304 | A | 12/1999 | Seelig | |
| 2002/0057164 | A1* | 5/2002 | Jin | H01F 38/14 336/115 |
| 2003/0146062 | A1 | 8/2003 | Futschek | |
| 2003/0173936 | A1* | 9/2003 | Sezgin | H01F 38/18 322/59 |
| 2006/0131294 | A1 | 6/2006 | Lindig | |
| 2007/0195924 | A1* | 8/2007 | Krumme | A61B 6/56 378/15 |
| 2008/0122294 | A1* | 5/2008 | Simon | H02J 5/005 307/104 |
| 2009/0116618 | A1* | 5/2009 | Nakayama | A61B 6/035 378/107 |
| 2009/0189459 | A1* | 7/2009 | Seefried | H01F 38/14 307/104 |
| 2013/0214614 | A1 | 8/2013 | Krumme | |

FOREIGN PATENT DOCUMENTS

| | | | |
|---|---|---|---|
| DE | 20204584 | U1 | 8/2003 |
| DE | 102006020808 | A1 | 11/2006 |
| DE | 202010012270 | U1 | 12/2011 |
| EP | 1690268 | A1 | 8/2006 |
| EP | 2377133 | A1 | 10/2011 |
| JP | S58220410 | A | 12/1983 |
| JP | 2011047158 | A | 3/2011 |
| JP | 2013110916 | A | 6/2013 |
| WO | 9217929 | A1 | 10/1992 |
| WO | 2008058627 | A2 | 5/2008 |
| WO | 2012041554 | A1 | 4/2012 |
| WO | 2013072373 | A1 | 5/2013 |

OTHER PUBLICATIONS

Office Action in corresponding German application No. 10 2015 100 233.7, dated Sep. 15, 2015, 4 pages.

Notice of Opposition of the German Patent Office in corresponding German Application No. 10 2015 100 233.7, dated Jan. 1, 2017, 3 pages.

* cited by examiner

INDUCTIVE ROTARY TRANSMITTER

RELATED APPLICATION(S)

This application claims the benefit of German Patent Application No. DE 10 2015 100 233.7 filed Jan. 9, 2015, the contents of which are incorporated herein by reference as if fully rewritten herein.

TECHNICAL FIELD

The invention relates to an inductive rotary transmitter or rotary transformer. The inductive rotary transmitter is to be understood to mean an inductive energy transmitter for a rotating system having a rotor and a stator. The rotor has a rotor winding and the stator has a stator winding, which are magnetically coupled to one another. In this way, energy can be transmitted inductively and in a contact-free manner from the rotor to the stator and vice versa.

BACKGROUND

Inductive rotary transmitters are known in various embodiments. For example, DE 202 04 584 U1 or DE 101 07 577 A1 each disclose a rotary transmitter, wherein the stator and the rotor each have a winding and each have a magnetisable core. The rotor and the stator are arranged coaxially with one another.

An inductive rotary transmitter is known from DE 10 2006 020 808 A1. At least the rotor or the stator has a carrier made of plastics material having soft-magnetic particles, which carries the associated coil.

The rotary transmitter known from DE 26 57 813 A1 has two cores arranged concentrically with one another, each having a winding. The rotary transmitter serves to transmit electrical signals. The stator winding and the rotor winding are each applied to a substrate as an endless coil in the manner of a printed circuit. The windings are each glued into a groove in the associated hollow-cylindrical ferrite core.

A further exemplary embodiment of an inductive rotary transmitter is described in WO 2013/072373 A1. The stator core there has two stator limbs extending parallel to one another, in each of which a rotary bearing is provided. The rotor is arranged between the two limbs of the stator core and has a rotor core and a rotor winding. The two parallel stator limbs are connected to one another by a connection limb extending transversely thereto, on which connection limb a stator winding is arranged. In one exemplary embodiment each stator limb may have integrally formed limb parts, which are arranged in a cross-shaped manner and which intersect one another in the region of the axis of rotation of the rotor.

In the case of the inductive rotary transmitter described from DE 20 2010 012 270 U1 the stator winding and the rotor winding are arranged concentrically with the axis of rotation. The windings may be arranged axially side by side or concentrically with one another. Each winding is assigned a magnetisable core. In a modification, it is also possible to use air coils without core.

For transmission, a magnetic circuit is produced between the stator winding and the rotor winding in the case of inductive rotary transmitters, wherein the magnetic field lines are guided via a magnetic circuit having magnetisable cores on the stator side and rotor side. In order to ensure the efficiency of the inductive energy transmission, the parts of the magnetic circuit moving relative to one another must be manufactured and mounted very accurately. In order to achieve a uniform energy transmission in the circumferential direction about the axis of rotation of the rotor at the air gap of the magnetic circuit, the magnetisable cores of the stator and of the rotor are continuous and in particular rotationally symmetrical in the circumferential direction about the axis of rotation of the rotor.

SUMMARY

On this basis, the object of the present invention can be considered that of creating an inductive rotary transmitter which ensures effective energy transmission and a more flexible adaptation to installation conditions in the respective device and which is significantly simplified in respect of the soft-magnetic components.

The rotary transmitter has a rotor mounted so as to be rotatable relative to a stator about an axis of rotation. The rotor carries a rotor winding. There is no magnetic or magnetisable core provided on the rotor. The rotor is free from magnetisable or magnetic material electromagnetically coupled to the rotor winding and/or the stator winding. The rotor, which carries the rotor winding, is preferably produced from a material that has a relative permeability of approximately 1. The magnetic field therefore is not influenced by the rotor or is only insignificantly influenced by the rotor.

The stator has a stator winding. In addition, a number of separate, magnetisable and preferably ferromagnetic or soft-magnetic stator elements are arranged on the stator. Two stator elements arranged directly side by side are preferably arranged at a distance from one another or bear against one another alternately in the circumferential direction about the axis of rotation D. Each stator element overlaps both the stator winding and the rotor winding in a radial direction radially to the axis of rotation on both axially opposite sides of the rotor winding or of the stator winding as considered along the axis of rotation. With the aid of the stator element, annularly closed magnetic field lines or magnetic circuits can thus be formed, and therefore an inductive coupling can be created between the stator winding and the rotor winding for energy transmission.

The separate stator elements may each be formed identically. The number of stator elements is dependent on the specific application and the required conductance capability. The arrangement and the distance between the provided stator elements may vary and may be adapted to the respective installation conditions of the inductive rotary transmitter. It is possible, but not necessary, for the stator elements to be arranged around the entire circumference about the axis of rotation. In one exemplary embodiment, the stator elements and/or the stator winding may be provided in the circumferential direction about the axis of rotation merely in a circumferential portion. This circumferential portion is less than 360°, preferably less than 180°, and more preferably less than 90°. The inductive coupling between the rotor and stator winding is therefore not provided along the entire circumference of the rotor winding, but merely in the circumferential portion in which the stator winding or the stator elements is/are arranged.

Since the rotor does not have any ferromagnetic or soft-magnetic materials (stator magnetic core) for magnetic coupling to the stator winding and the stator elements, the rotating mass can be minimised.

Due to the separate stator elements, a flexible adaptation of the inductive rotary transmitter to the respective installation conditions can be made. The course of the magnetic field lines or of the magnetic circuit is predefined on the stator side on the basis of the stator winding and the stator elements. The magnetic reversal in the case of an alternating current through the stator winding takes place exclusively on the stator side. For inductive coupling, merely the rotor winding is provided on the rotor side, such that no significant hysteresis losses occur there.

In an advantageous embodiment all stator elements are assigned to a common stator winding and are magnetically coupled thereto. In particular, merely a single stator winding is provided.

The stator winding in one exemplary embodiment may be arranged concentrically about the axis of rotation and/or concentrically about the rotor winding. In this embodiment the stator winding surrounds the axis of rotation completely. Alternatively, as already mentioned above, it is also possible for the stator winding to be arranged about the axis of rotation only in a circumferential portion smaller than 360°, preferably smaller than 180°, and more preferably smaller than 90°. A very compact, space-saving design of the stator-side component parts of the rotary transmitter can thus be achieved.

The stator elements may be arranged in a manner distributed in the circumferential direction about the axis of rotation, wherein stator elements arranged directly side by side are preferably each arranged at the same distance from one another in the circumferential direction. Alternatively, it is also possible to vary the distance between the stator elements. In particular when the stator winding is arranged merely in a circumferential portion, the stator elements are also arranged merely in this circumferential portion for magnetic coupling to the stator winding.

It is advantageous when each stator element in the circumferential direction about the axis of rotation has an inner region open on both sides, through which the rotor winding and the stator winding extend. A radial distance is provided in this inner space between the rotor winding and the stator winding in order to ensure contact-free relative rotation.

Is also advantageous when each stator element has two mutually opposed delimiting faces running parallel to one another which delimit therebetween an air gap. The air gap is penetrated by the magnetic field lines of the stator element in question. The rotor passes through the air gap.

The stator element may be formed in one piece without seams and joints. Such an embodiment is advantageous in particular when the stator element has a U-shaped design with an axial limb and two radial limbs extending away from the axial limb parallel to one another. The inner region of the stator element provided axially between the two radial limbs here preferably has a constant axial height. The delimiting faces are formed on the faces of the radial limbs facing towards one another and bordering the inner region. Here, the air gap necessary to allow the rotor to pass through is identical, in terms of its axial extension, to the clearance provided for the rotor winding and the stator winding.

In a further preferred exemplary embodiment each stator element has two interconnected element parts. The two element parts may be interconnected for example by means of two connection faces bearing against one another. The connection faces extend preferably in a common connection plane, which may be oriented at right angles to the axis of rotation.

Is advantageous here when each element part of a stator element has one of the delimiting faces arranged in a mutually opposed manner in order to delimit the air gap. In order to minimise the production effort it is advantageous when the element parts are identical.

The two element parts or the stator element consist or consists preferably of a soft-magnetic material.

The element parts are preferably interconnected in an integrally bonded manner, for example by means of an adhesive bond.

In an advantageous exemplary embodiment each stator element has two side faces pointing in the circumferential direction about the axis of rotation, each of said side faces being arranged in a radial plane. The radial planes extend radially relative to the axis of rotation. As a result of this embodiment, the form of the stator elements is adapted to the course of the magnetic field lines, which is radial in portions. The stator elements may additionally be arranged side by side in the circumferential direction as closely to one another as desired. Where necessary, the stator elements may also bear against one another via the side faces facing towards one another.

In this embodiment the two radial planes in which the side faces of a stator element extend enclose an angle with one another from approximately 5° to approximately 20° and in particular from approximately 10° to approximately 15°.

It is preferable if the rotor has a ring or an annular disc or is formed by a ring or an annular disc. The rotor winding is arranged at an end of the ring or the annular disc remote from the axis of rotation. In the case of the annular disc the rotor winding is preferably located at the radially outer end of the annular disc. The annular disc more preferably extends parallel to an axial plane oriented at right angles to the axis of rotation.

The rotor inclusive of the contour of the rotor winding is preferably rotationally symmetrical with respect to the axis of rotation. The rotor inclusive of the contour of the rotor winding may additionally be formed symmetrically with respect to a plane of symmetry extending at right angles to the axis of rotation.

In all embodiments the stator winding may be arranged radially or axially adjacently to the rotor winding, either as a whole or at least via a winding portion penetrating the inner regions of the stator elements.

Further advantageous embodiments of the rotary transmitter will emerge from the dependent claims, the description and the drawing. Preferred exemplary embodiments will be explained in detail hereinafter with reference to the accompanying drawing, in which:

DETAILED DESCRIPTION

Figure 1:
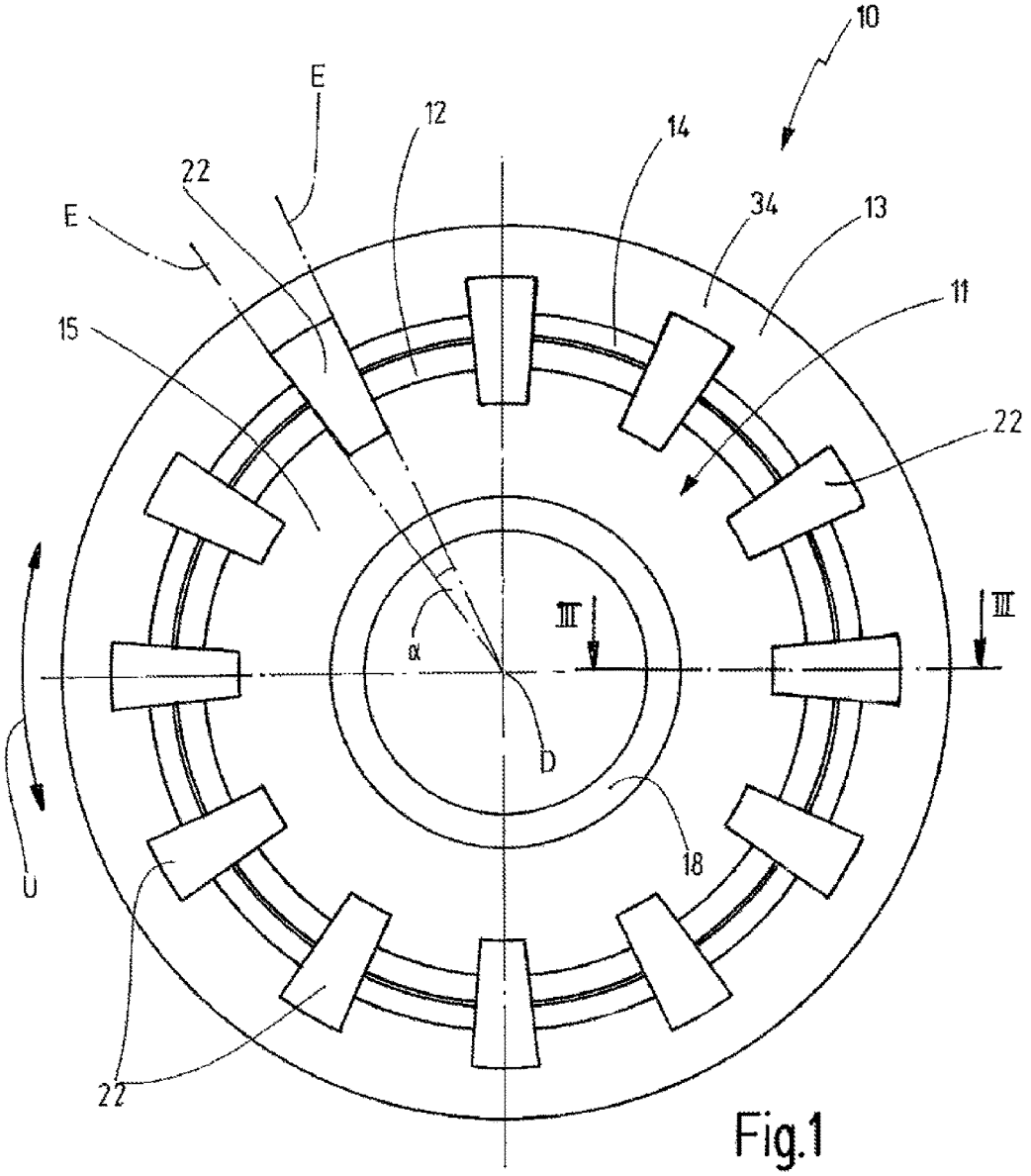
FIG. 1 shows a first exemplary embodiment of an inductive rotary transmitter in a plan view in the direction of an axis of rotation of the rotor.

The drawing shows various exemplary embodiments of an inductive energy transmitter formed as a rotary transmitter 10. The rotary transmitter 10 has a rotor 11, which carries a rotor winding 12 and is mounted so as to be rotatable about an axis of rotation D relative to a stator 13 having a stator winding 14. A circumferential direction U is oriented concentrically about the axis of rotation D.

As the rotor 11 having the rotor winding 12 rotates, there is no contact with the stator 13 or the stator winding 14. The energy is inductively transmitted without contact from the stator winding 14 to the rotor winding 12 or vice versa.

In the preferred exemplary embodiments according to FIGS. 1 to 6 the rotor 11 has an annular disc 15 arranged coaxially with the axis of rotation D. The annular disc 15 extends in these exemplary embodiments parallel to a plane oriented at right angles to the axis of rotation D. The rotor winding 12 is secured at its radially outer end 16.

The rotor winding 12 is for example arranged concentrically with the axis of rotation D. The rotor 11 and the contour of the rotor winding 12 are rotationally symmetrical with respect to the axis of rotation D. Apart from the rotor winding 12, there are no magnetic or magnetisable parts provided on the rotor 11 which serve for the magnetic coupling and inductive energy transmission to the stator winding 14. In particular, there is no ferromagnetic or soft-magnetic core arranged on the rotor 11. The electromagnetic coupling is provided on the rotor side exclusively by the rotor winding 12. The rotor 11 and the annular disc 15 consist of a material, for example of a plastics material, which does not significantly impair the magnetic field and has a relative permeability $\mu_r$ of approximately 1.

At the radially inner end 17 opposite the radially outer end 16, the annular disc 15 is connected to a bearing part 18, by means of which the rotor 11 can be mounted rotatably about the axis of rotation D.

Figure 2:
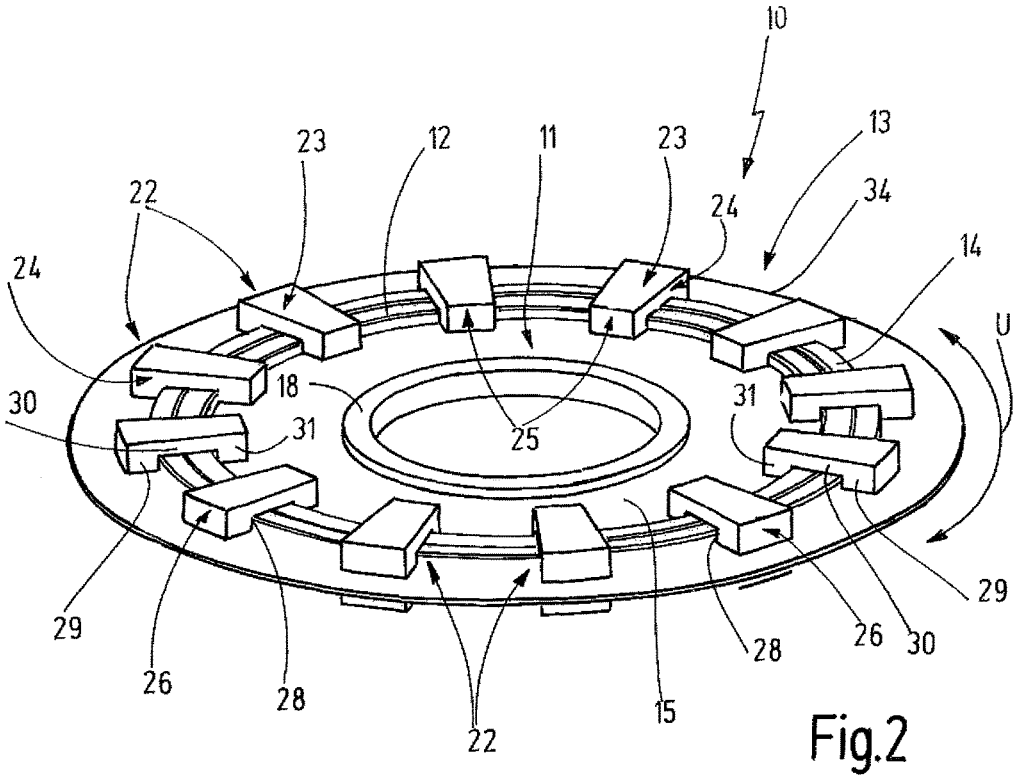
FIG. 2 shows the exemplary embodiment of the rotary transmitter from FIG. 1 in a perspective illustration.
Figure 3:
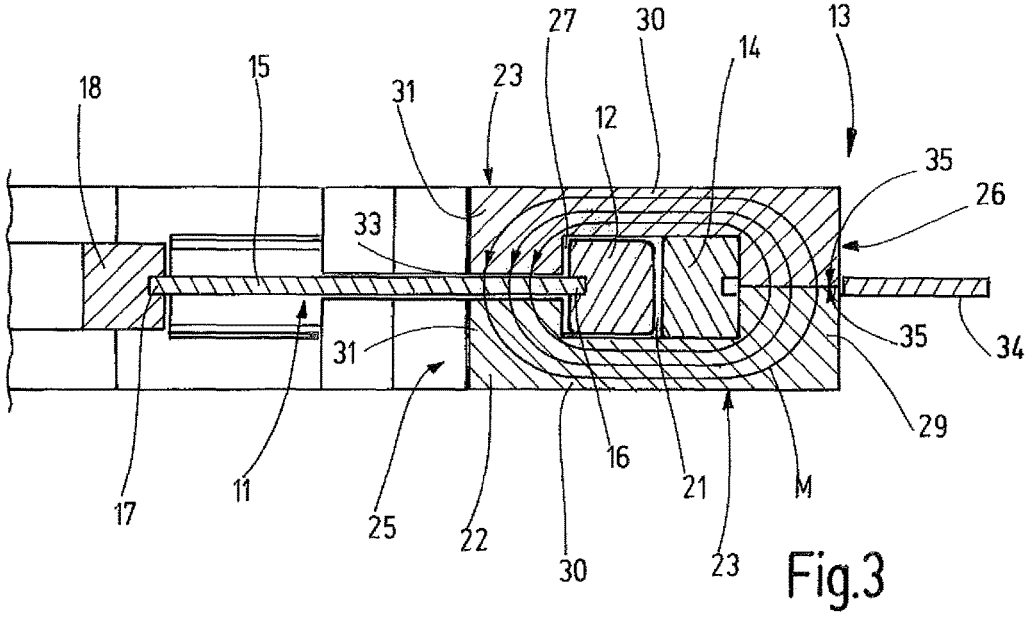
FIG. 3 shows a sectional partial view of the exemplary embodiment of the rotary transmitter from FIGS. 1 and 2 in accordance with the line of section in FIG. 1.

In the first exemplary embodiment according to FIGS. 1 to 3, the stator winding 14 is arranged coaxially with the axis of rotation D and extends in the circumferential direction U around the rotor winding 12. A clearance 21 is provided between the rotor winding 12 and the stator winding 14, such that a contact-free relative rotation is possible between the two windings 12, 14.

In order to guide the magnetic field lines M (see FIG. 3), a number of stator elements 22 are arranged on the stator 13. In the first exemplary embodiment according to FIGS. 1 to 3, the stator elements 22 are each arranged in a manner distributed in the circumferential direction U about the axis of rotation D at the same distance from one another. By contrast, the distance between two directly adjacent stator elements 22 may also vary.

Figure 7:
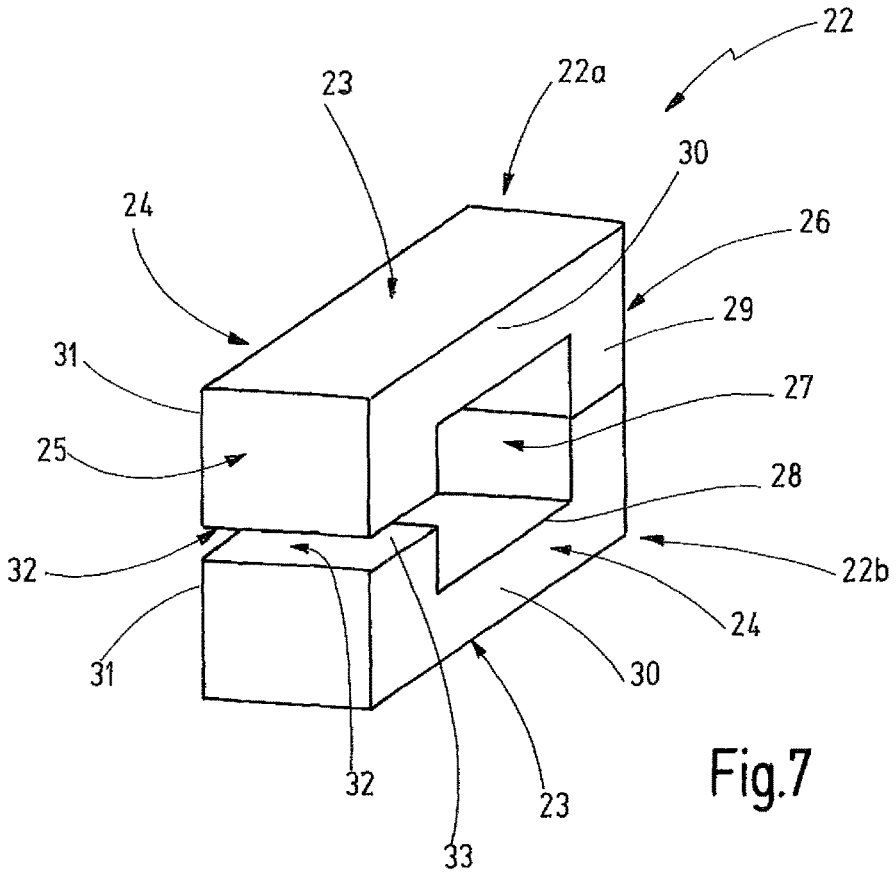
FIG. 7 shows a prospective illustration of an exemplary embodiment of a stator element from the exemplary embodiments of the rotary transmitter in accordance with FIGS. 1 to 6.

The stator element 22 is illustrated prospectively in FIG. 7. As considered in the direction of the axis of rotation D, it has two axial faces 23 oriented parallel to one another and at right angles to the axis of rotation D. The two axial faces 23 are connected to one another by two side faces 24 each pointing in the circumferential direction U. The stator element 22 has, in a radial direction radially to the axis of rotation, a radially inner face 25 and an opposed radially outer face 26 pointing away from the axis of rotation D. The radially inner face 25 and the radially outer face 26 are preferably curved coaxially with the axis of rotation D. In a modification, these faces 25, 26 could also extend in a plane tangentially to the circumferential direction U.

The two side faces 24 are preferably not oriented parallel to one another, but each extent in a radial plane E. The radial planes E contain the axis of rotation D and extend radially hereto. The radial planes E are illustrated schematically in FIGS. 1 and 4. In a plan view of an axial face 23, the stator element 22 has a form tapering in a wedge-shaped manner towards the axis of rotation D.

The two radial planes E enclose with one another an angle $\alpha$. The angle $\alpha$ lies in the range from approximately 5° to approximately 20° and preferably in a range from approximately 10° to approximately 15°.

The stator element 22 delimits an inner region 27, which is open in the circumferential direction U and thus has a mouth 28 on each side face 24. The mouths 28 in accordance with the example have a rectangular contour. The inner region 27 penetrates the stator element 22 completely in the circumferential direction U between the two mouths 28.

The stator element 22 in accordance with the example has a C-shaped or bracket-shaped design. It has an axial limb 29, on which the radially outer face 26 is arranged and which extends approximately parallel to the axis of rotation D. Two radial limbs 30 protrude away from this axial limb 29 at a distance from one another. The two radial limbs 30 each have an axial face 23 and extend on opposite sides of the inner region 27. An axial protrusion 31 is provided on each radial limb 30 at the radially inner end opposite the axial limb 29. The two axial protrusions 31 extend towards one another and are arranged opposite one another in each case via a delimiting face 32 and distanced from one another. An air gap 33 is located between the two delimiting faces 32. The air gap 33 is delimited exclusively by the two delimiting faces 32 and is otherwise open on all sides. The inner region 27 is therefore radially accessible towards the axis of rotation D via the air gap 33.

The rotor 11 and in accordance with the example the annular disc 15 protrude through the air gap 33. Both the rotor winding 12 and the stator winding 14 penetrate the inner region 27 in the circumferential direction U of each stator element 22. Here, the stator winding 14 may be connected to the stator elements 22, since here no relative movement takes place. By contrast, the rotor winding 12 and the rotor 11 has no contact with the stator elements 22 or the stator winding 14. The stator elements 22 overlap both the rotor winding 12 and the stator winding 14 at a respective mounting point of the stator element 22 in order to establish an electromagnetic coupling between the stator winding 14 and the rotor winding 12.

The stator elements 22, in the exemplary embodiment illustrated in FIGS. 1 to 3, are secured to an annular carrier 34 of the stator 13. The axial limb 29 here penetrates a respective opening in the annular carrier 34. The stator winding 14 is also secured to the annular carrier 34.

The stator element 22 is divided in accordance with the example into two element parts 22*a*, 22*b*. The two element parts 22*a*, 22*b* are interconnected fixedly and preferably in an integrally bonded manner, for example by an adhesive bond, in order to form the stator element 22. For this purpose, each element part 22*a*, 22*b* has a connection face 35, and these bear against one another when the connection has been produced. The connection faces 35 extend in the preferred exemplary embodiment in a connection plane that is preferably oriented at right angles to the axis of rotation D. The annular disc 15 and the annular carrier 34 may be oriented parallel to this connection plane or may be arranged symmetrically with respect thereto.

The two element parts 22*a*, 22*b* are identical. Each stator element 22 is produced by two such element parts 22*a*, 22*b*. Each element part 22*a*, 22*b* has one of the two radial limbs 30 and one of the two axial protrusions 31. Part of the axial limb 29, and in accordance with the example half of the axial limb 29, is provided on each element part 22*a*, 22*b*. The stator element 22 is thus separated into two element parts 22*a*, 22*b* in the region of the axial limb 29.

Alternatively, is also possible to produce the stator elements 22 in one piece without seams and joints, however this requires a greater production effort in the case of C-shaped stator elements 22 and may complicate the mounting on the stator 13.

In all exemplary embodiments all stator elements 22 are identical. The number and the distance between the stator elements 22 may be adapted in a flexible manner depending on the specific application and the situation of installation of the rotary transmitter 10. All stator elements in accordance with the example are assigned to a common stator winding 14 and magnetically coupled thereto.

The inductive contact-free rotary transmitter 10 according to FIGS. 1 to 3 functions as follows.

It is assumed that electrical energy is to be transferred from the stator 13 to the rotor 11. For this purpose, a current which generates a magnetic field is passed through the stator winding 14. A magnetic field with annularly closed magnetic field lines M thus forms in the stator elements 22. The magnetic field lines M penetrate the axial limb 29, the adjoining radial limb 30, the adjoining axial protrusion 31, the air gap 33, the other axial limb 31, the other radial limb 30, and thus form an annularly closed form, which is illustrated schematically in FIG. 3. The direction of the magnetic field lines M is dependent here on the current direction through the stator winding 14. The arrows of the magnetic field lines M in FIG. 3 are therefore merely exemplary.

The magnetic field and the closed magnetic circuit are consequently formed exclusively on the stator side. There are no ferromagnetic or soft-magnetic component parts provided on the rotor side which serve to form the closed magnetic circuit along the stator elements 22. The magnetic field lines M penetrate the annular disc 15 of the rotor 11 in the air gap 33. Since this does not contain any ferromagnetic or soft-magnetic component parts in the region of the stator elements 22 and in particular in the region of the air gap 33, the magnetic field in the air gap 33 is not impaired by the annular disc 15. Since the rotor winding 12 is surrounded by the magnetic field lines M, electrical energy can thus be transmitted inductively and contact-free to the rotor winding 12.

The rotor winding 12 may have two or more electrical terminals or taps, which can be guided in or on the annular disc 15 and for example may also be formed as conductive tracks. The arrangement, layout and embodiment of the electrical connection lines relative to the rotor winding 12 can be adapted to the respective installation conditions.

Since the rotor 11 does not have any ferromagnetic or soft-magnetic materials for magnetic coupling to the stator 13, the rotating mass can be reduced. Closed magnetic field lines M form within each stator element 22. The magnetic field lines M do not extend in ferromagnetic or soft-magnetic parts of the rotor 11, such that a closed magnetic circuit so to speak is produced solely on the stator side.

Figure 4:
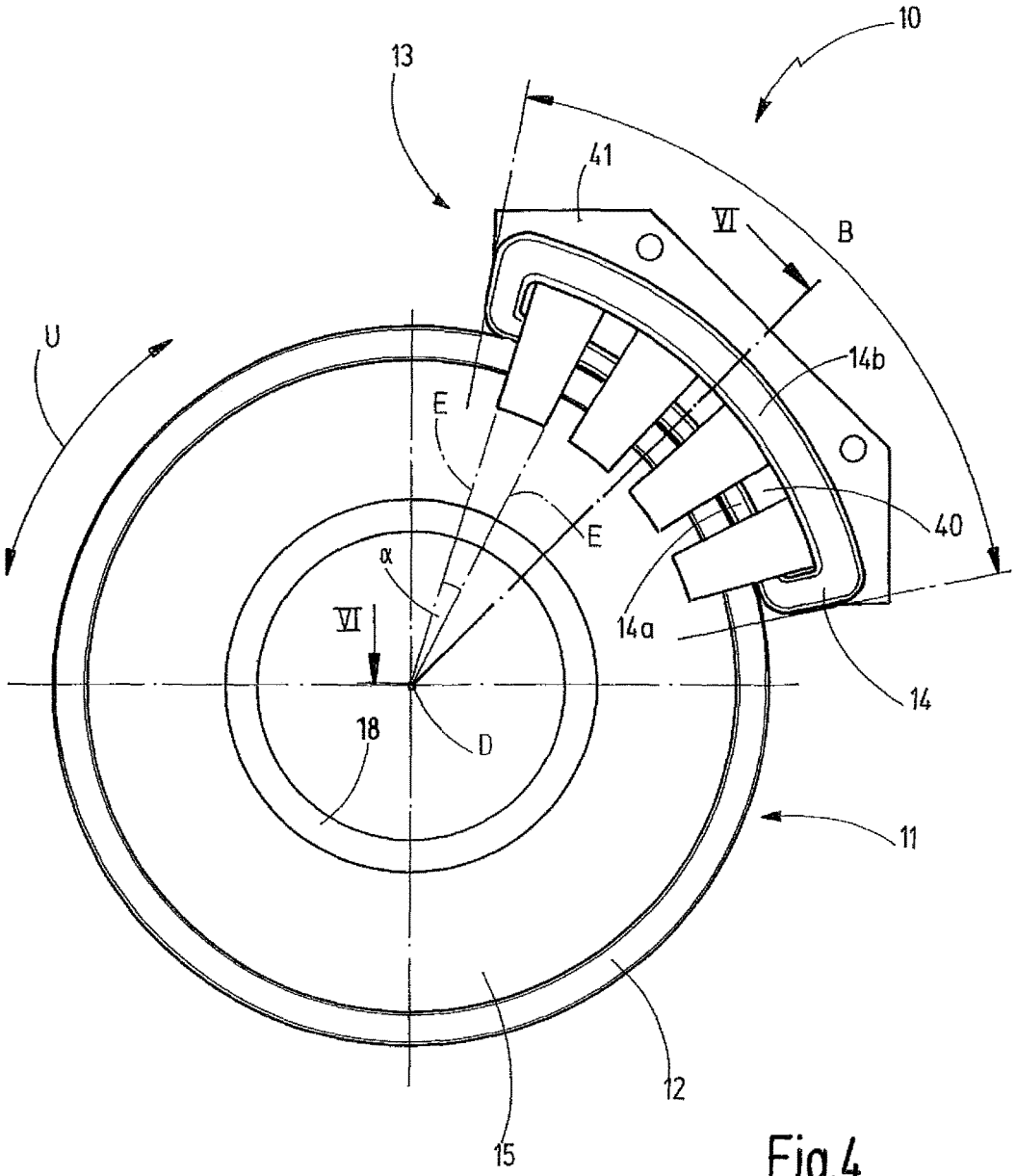
FIG. 4 shows a further exemplary embodiment of a rotary transmitter in a plan view along an axis of rotation of the rotor.
Figure 5:
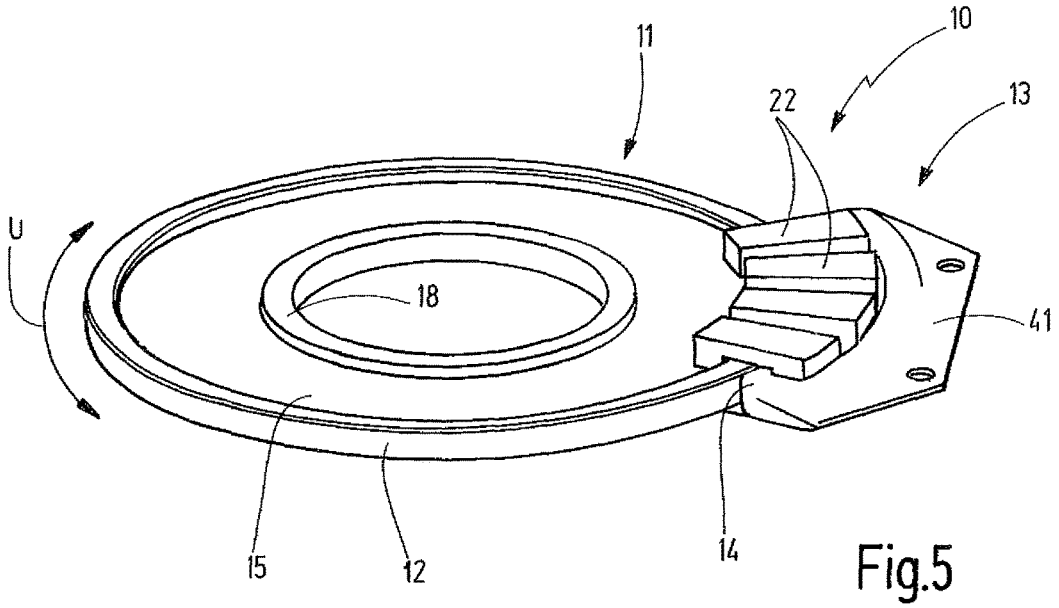
FIG. 5 shows a perspective view of the exemplary embodiment of the rotary transmitter from FIG. 4.
Figure 6:
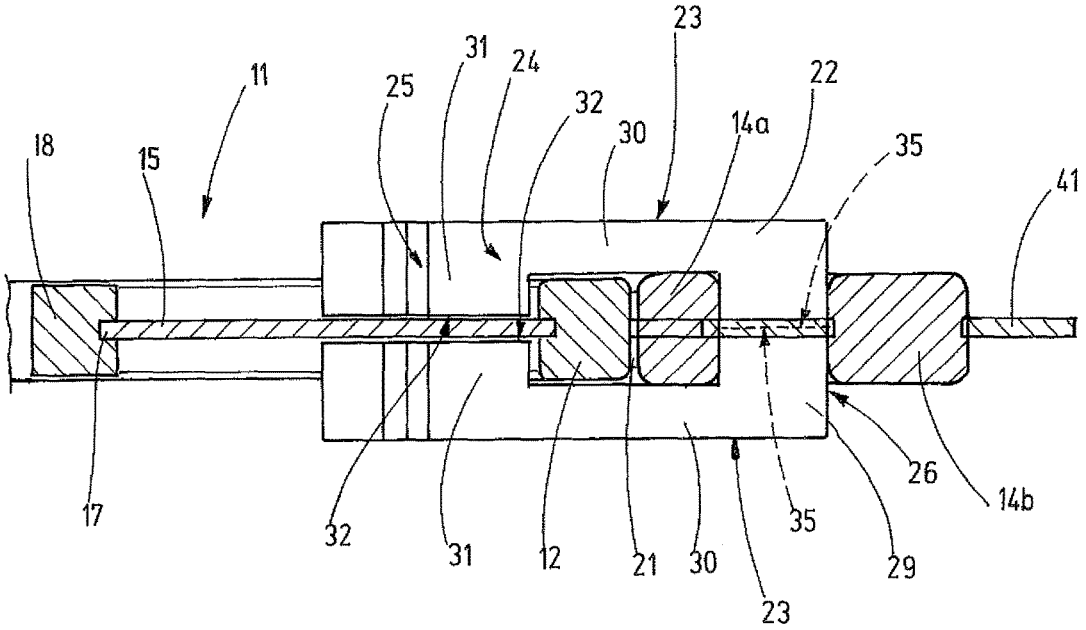
FIG. 6 shows a sectional partial illustration of the exemplary embodiment of the rotary transmitter from FIGS. 4 and 5 in accordance with the line of section VI-VI in FIG. 4.

In FIGS. 4 to 6 a second exemplary embodiment of the rotary transmitter 10 is illustrated. The main difference between this second exemplary embodiment and the previously described first exemplary embodiment lies in the fact that the stator winding 14 and the stator segments 22, as considered in the circumferential direction U, is/are limited to a circumferential portion B about the axis of rotation D which is smaller than 360°. The circumferential portion B is at most 180°, whereby a radial assembly or disassembly of the rotor 11 and of the stator 13 relative to one another as possible. In the exemplary embodiment the circumferential portion B is less than 90° (FIG. 4). The size or circumferential extent of the circumferential portion can be can be selected depending on the respective application.

The stator winding 14 is laid in a closed loop within the circumferential portion B and has an inner winding portion 14*a* and an outer winding portion 14*b*. The two winding portions 14*a*, 14*b* are arranged in accordance with the example concentrically with the axis of rotation D and at a distance from one another in the circumferential portion B. A winding inner region 40 is enclosed by the stator winding 14 between the two winding portions 14*a*, 14*b*.

A portion of the provided stator elements 22, and in accordance with the example the axial limb 29, extends through this winding inner region 40. The stator elements 22 are likewise arranged exclusively within the circumferential portion B. Within this circumferential portion B the arrangement of the second exemplary embodiment (FIGS. 4 to 6) corresponds substantially to the arrangement according to FIGS. 1 to 3, wherein the main difference lies in the fact that in the second exemplary embodiment two winding portions 14*a* and 14*b* are provided one on each side of the axial limb 29 in the radial direction relative to the axis of rotation D, whereas in the first exemplary embodiment the stator winding 40 extending in an annular manner is arranged merely on the radially inner side.

Since the stator 13 in the second exemplary embodiment is limited substantially to the circumferential portion B, it is not necessary to provide an annularly closed carrier for the stator elements 22 and the stator winding 14. Instead of the annular carrier 34 of the first exemplary embodiment, a suitable carrier element 41 for the stator winding 14 and the stator elements 22 is provided in the second exemplary embodiment according to FIGS. 4 to 6 and it can be formed in a plate-shaped manner. The contour of the carrier element 41 is freely selectable and can be adapted to the installation conditions of the rotary transmitter 10 in a device.

On the basis of the two exemplary embodiments explained above, it is clear that the stator 13 and the stator winding 14 and the stator winding 22 do not have to be arranged along the entire rotor 11 or the rotor winding 12 in the circumferential direction U. Rather, the stator-side embodiment of the rotary transmitter 10 can be adapted to the respective application and the installation space conditions. Since the closed magnetic circuit is generated via the stator winding 14 and the stator elements 22 merely on the stator side, it is not necessary to form the stator 13 and in particular the stator winding 14 and the stator elements 22 so as to be continuously or annularly closed in the circumferential direction U. The magnetisable stator elements 22, which preferably consist of soft-magnetic material, are formed as elements that can be handled separately. The distance between two adjacent stator elements 22 in the circumferential direction U about the axis of rotation D can be selected in a variable manner depending on the application. It is also possible to rest two adjacent stator elements 22 against one another via the associated side faces 24, such that the distance so to speak is reduced to zero. It is nevertheless sufficient to arrange the stator winding 14 and the stator elements 22 in a circumferential portion B.

Figure 8:
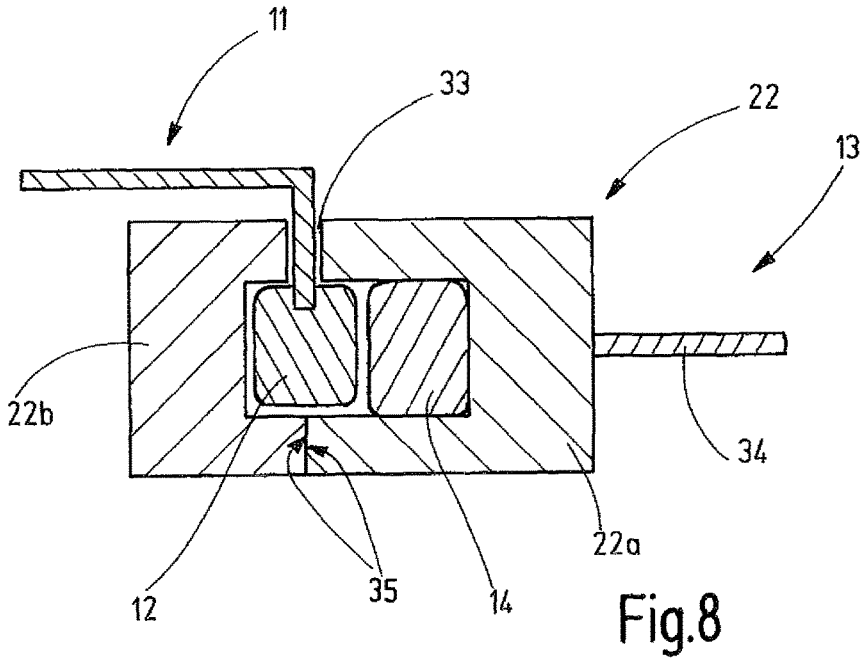
FIG. 8 shows a modified exemplary embodiment of a rotary transmitter in a sectional partial illustration in the region of one of the stator elements.

In the case of the previously described exemplary embodiments, the stator elements 22 according to the embodiment are formed in accordance with FIG. 7. In a modification, the stator element 22 could also be formed in such a way that the air gap 33 does not extend at right angles to the axis of rotation D, but for example parallel or at an incline to and concentrically about the axis of rotation D, which is illustrated by way of example in FIG. 8. In this embodiment the rotor 11 has a modified design. It has a cylindrical ring 42, which is arranged concentrically with the axis of rotation D and which carries the rotor winding 12. The ring 42 passes through the air gap 33 of the respective stator element 22. The two element parts 22*a*, 22*b*, from which the stator element 22 is formed in the exemplary embodiment according to FIG. 8, are not identical, but instead their contours differ from one another. The connection faces 35, by means of which the two element parts 22*a*, 22*b* are connected to one another, can be provided at a suitable point. In accordance with the example, the connection faces 35 extend parallel to the axis of rotation D as considered relative to the air gap 33.

In the case of the previously described exemplary embodiments the rotor winding 12 and the stator winding 14 are arranged side by side radially relative to the axis of rotation D. In a modification it is also possible to arrange the rotor winding 12 and the stator winding 14 side by side axially, i.e. in a direction parallel to the axis of rotation D, as is the case in the exemplary embodiments according to FIGS. 9 to 14. A combination of radial and axial overlap of the windings 12, 14 is also possible.

Figure 11:
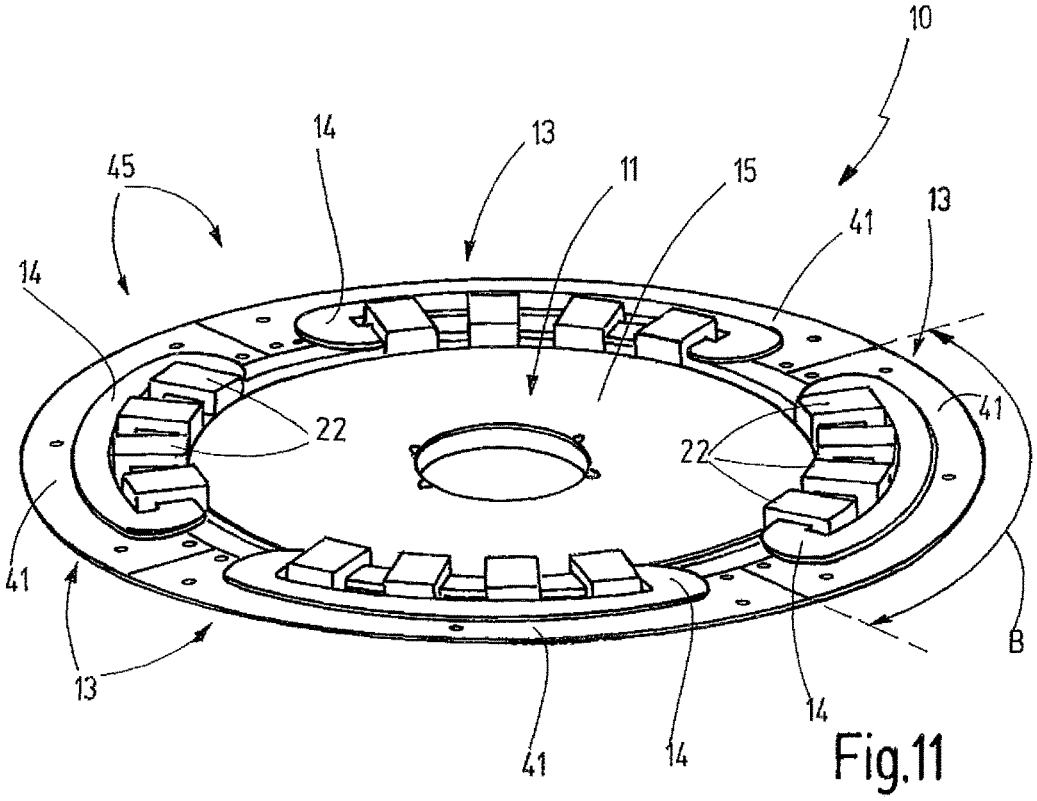
FIG. 11 shows a further exemplary embodiment of a rotary transmitter in a perspective view.
Figure 12:
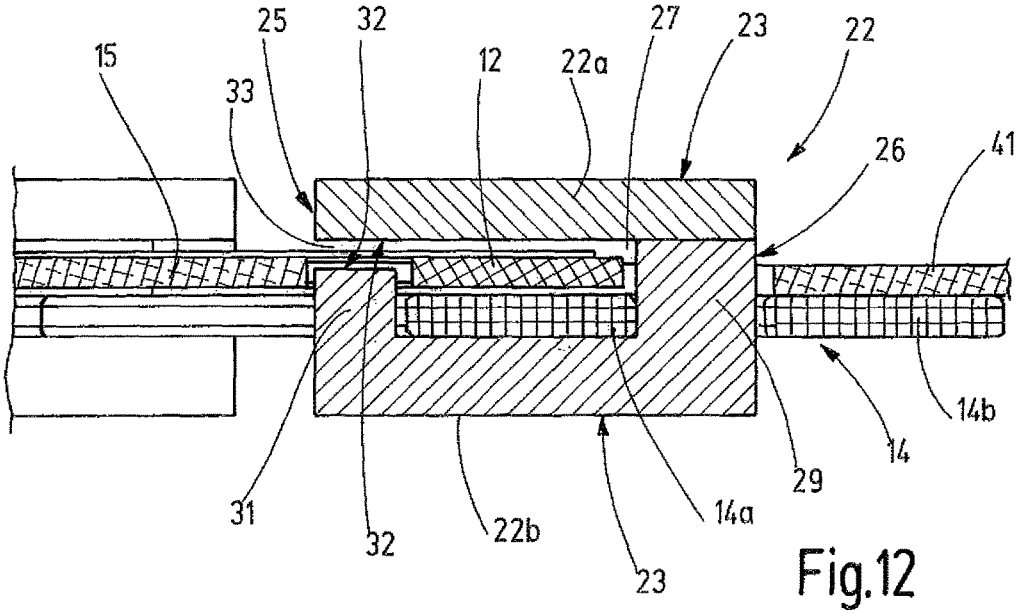
FIG. 12 shows a sectional partial illustration of the exemplary embodiment of the rotary transmitter from FIG. 11.

In the exemplary embodiment according to FIGS. 11 and 12, at least the inner winding portion 14*a* of the stator winding 14 penetrating the inner regions 27 of the stator elements 22 is arranged axially adjacently to the rotor winding 12.

In the exemplary embodiments according to FIGS. 9 to 12, the stator elements 22 are each formed by two element parts 22*a*, 22*b* which are not identical, wherein in accordance with the example an axial protrusion 31 is provided only on one of the stator elements. A first element part 22*a* is rectangular in cross section, whereas the other, second element part 22*b* has a U-shaped cross section with limbs of different length. The shorter limb forms the axial protrusion 31. The other, longer limb of the second element part 22*b* forms a portion of the axial limb 29 of the stator element 22. There is no axial protrusion 31 provided on the first element part 22*a*.

Figure 10:
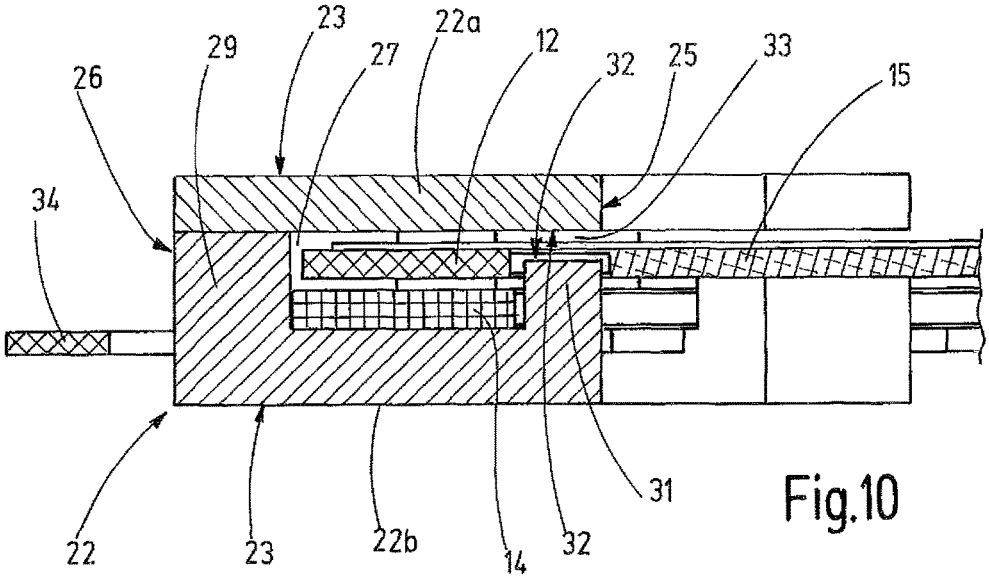
FIG. 10 shows a sectional partial illustration of the exemplary embodiment of the rotary transmitter from FIG. 9.

As is illustrated in FIGS. 10 and 12, the annular disc 15 passes through the air gap 33. The rotor winding 12 is arranged axially beside the stator winding 14. The 2 windings 12, 14 penetrate the inner region 27 in the circumferential direction U as in the other exemplary embodiments.

Figure 9:
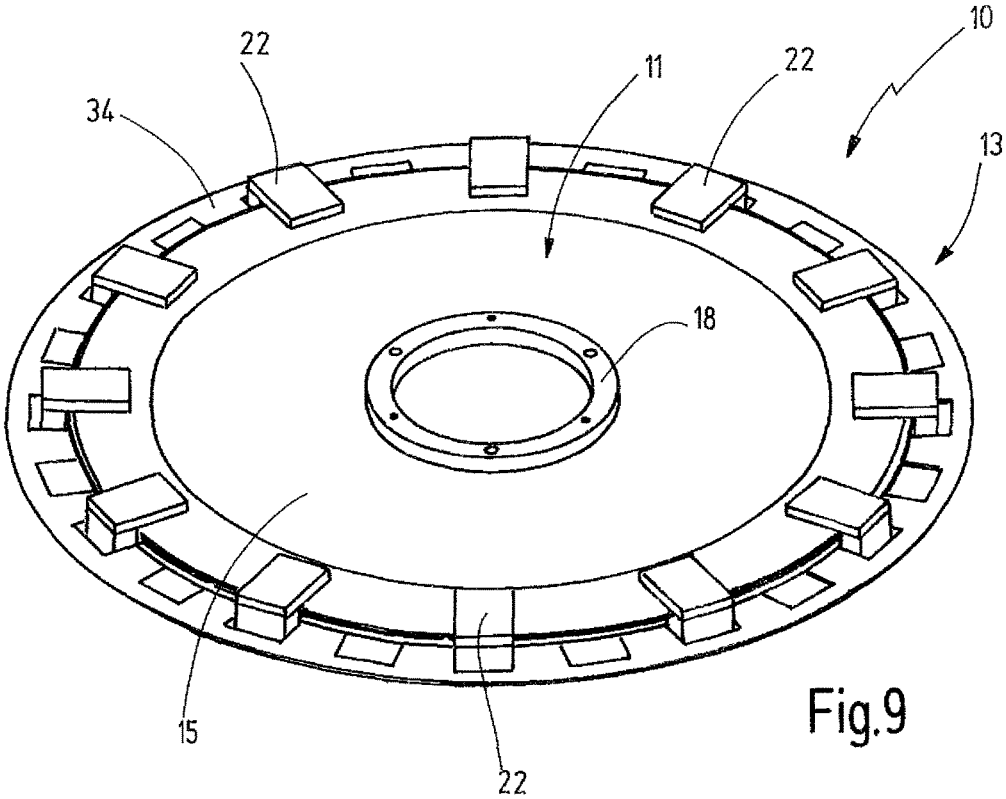
FIG. 9 shows a further exemplary embodiment of a rotary transmitter in a perspective view.

In the exemplary embodiment illustrated in FIGS. 9 and 10, the stator winding 14 is annularly closed in the circumferential direction U about the axis of rotation D. In a modification, the stator winding 14 in the exemplary embodiment according to FIGS. 11 and 12, similarly to the exemplary embodiment described on the basis of FIGS. 4 to 6, is arranged merely in a circumferential portion B and encloses the stator elements 22 provided there.

As shown schematically on the basis of FIG. 11, a number of stators 13 may also be provided in a circumferential portion B. The stators 13 or the respective carrier elements 41 adjoin one another in the circumferential direction U in accordance with the example and thus form a stator arrangement 45 that is annularly closed on the whole. In the exemplary embodiment shown in FIG. 11, four stators 13 are provided in order to form the stator arrangement 45. The number of the stators 13 may vary depending on the respective size of the circumferential portion B.

When the stator elements 22 of a stator 13 are arranged on a carrier element 41 and the carrier element 41 and the stator elements 22 extend merely over a circumferential region B that is smaller than 180° , the rotary transmitter 10 can be assembled and disassembled in a particularly simple manner. The stator 13 may be assembled or disassembled relative to the rotor 11 radially in relation to the axis of rotation D. Here, it may also be advantageous to limit the stator winding 14 to the circumferential region B.

Figure 13:
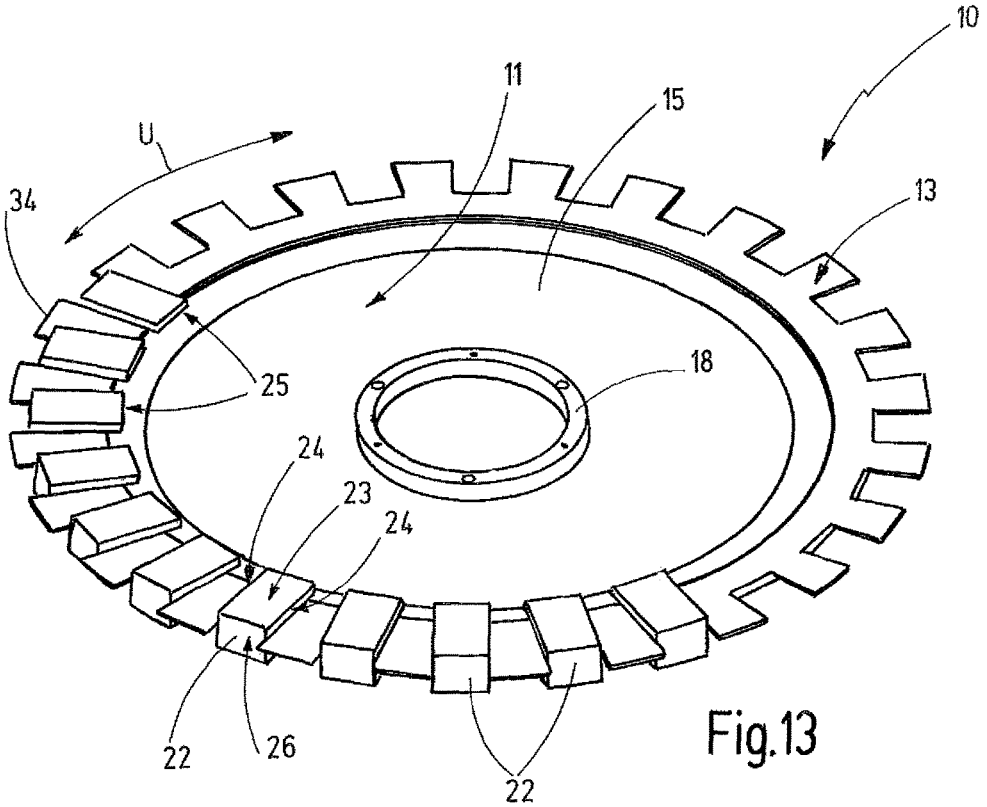
FIG. 13 shows a further exemplary embodiment of a rotary transmitter in a perspective view.
Figure 14:
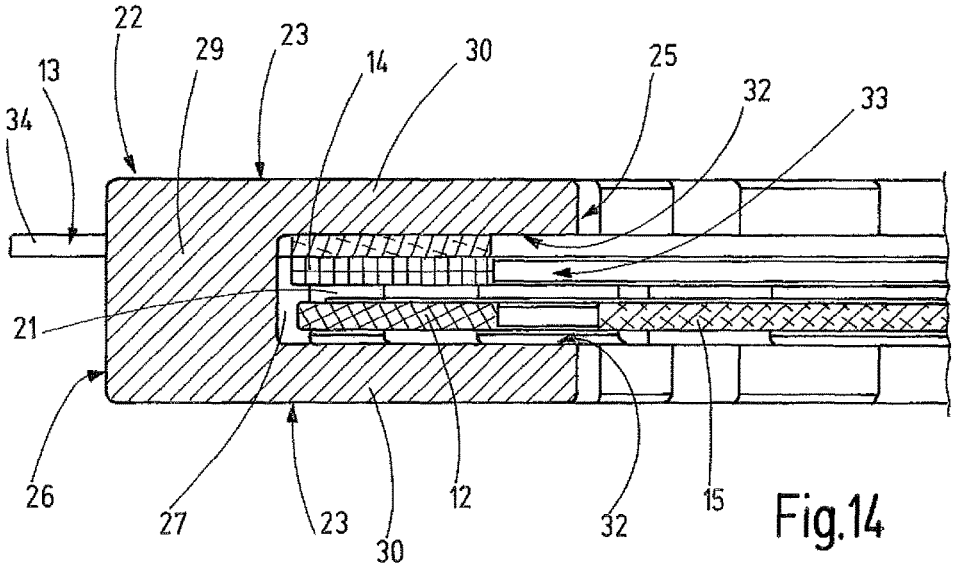
FIG. 14 shows a sectional partial illustration of the exemplary embodiment of the rotary transmitter from FIG. 13.

In FIGS. 13 and 14 a further modified exemplary embodiment is illustrated. By contrast with the exemplary embodiments described previously, the stator element 22 is U-shaped in cross section (FIG. 14). The axial protrusions 31 are omitted. The stator element 22 may therefore be produced in one piece without seams and joints and may still be easily assembled. The accessibility to the inner region 27 is possible without limitation due to be absence of axial protrusions 31. As is also the case in the exemplary embodiments according to FIGS. 9 to 12, the windings 12, 14 are arranged axially side by side in this embodiment as well.

It goes without saying that the above-described exemplary embodiments can also be combined with one another. By way of example, the C-shaped stator elements 22 can then also be inserted when the stator winding 14 and the rotor winding 12 are arranged radially side by side. In contrast to the exemplary embodiment illustrated in FIGS. 13 and 14, the stator winding 14 there also might not be annularly closed about the axis of rotation D, but, as illustrated by way of example in FIGS. 4 and 11, could be arranged only in a circumferential region B about the stator elements 22 provided there.

The invention relates to an inductive energy transmitter having a rotor 11 and a stator 13, which can rotate relative to one another, such that a rotary transmitter 10 is formed. A rotor winding 12 is arranged on the rotor 11, and a stator winding 14 is arranged on the stator 13. Apart from the rotor winding 12, the rotor 11 does not have any ferromagnetic or soft-magnetic material parts which serve for inductive coupling to the stator 13 or the stator winding 14. In particular, there is no soft-magnetic or ferromagnetic core provided on the rotor 11. The annularly closed magnetic field lines M of the magnetic field for inductive coupling are formed by separate stator elements 22, which are arranged on the stator side and which are produced from ferromagnetic or soft-magnetic material. The stator elements 22 overlap both the rotor winding 12 and the stator winding 14 at a respective mounting point of the stator element 22 and direct the magnetic field lines M around the rotor winding 12 and around the stator winding 14, such that there is a magnetic coupling between the stator winding 14 and the rotor winding 12.

LIST OF REFERENCE SIGNS

10 rotary transmitter
11 rotor
12 rotor winding
13 stator
14 stator winding
14*a* inner winding portion
14*b* outer winding portion
15 annular disc
16 radially outer end
17 radially inner end
18 bearing part
21 clearance
22 stator element
22*a* element part
22*b* element part
23 axial face
24 side face
25 radially inner face
26 radially outer face
27 inner region
28 mouth
29 axial limb
30 radial limb
31 axial protrusion
32 delimiting face
33 air gap
34 carrier
35 connection face
40 winding region
41 carrier element
42 ring
45 stator arrangement
α angle
B circumferential portion
D axis of rotation
E radial plane
M magnetic field line
U circumferential direction

The invention claimed is:

1. An inductive rotary transmitter (10) comprising:

a rotor (11), which is mounted so as to be rotatable about an axis of rotation (D), carries a rotor winding (12) that is arranged concentrically about the axis of rotation (D) and that is rotationally symmetrical with respect to the axis of rotation (D), and which is free from material that can be electromagnetically coupled to the rotor winding (12) and/or a stator winding (14), a stator (13), which carries the stator winding (14) consisting of a single stator winding and to which a plurality of separate, magnetisable stator elements (22) are secured, wherein each stator element (22) overlaps the stator winding (14) and the rotor winding (12) on both axial sides radially relative to the axis of rotation (D) to effect a magnetic coupling between the stator winding (14) and the rotor winding (12), wherein all of the stator elements (22) are magnetically coupled to the common stator winding (14), wherein the stator winding (14) is arranged concentrically about the axis of rotation (D), wherein the stator winding (14) and the rotor winding (12) are arranged axially side by side with respect to the axis of rotation (D), wherein the rotor 11 has a ring (42) or an annular disk (15) and the rotor winding (12) is arranged on one axial side at the outer periphery of the ring (42) or the annular disk (15), wherein the rotary transmitter is configured to transmit energy.

2. The inductive rotary transmitter according to claim 1, wherein the stator elements (22) are distributed uniformly in a circumferential direction (U) about the axis of rotation (D).

3. The inductive rotary transmitter according to claim 1, wherein each stator element (22) in a circumferential direction (U) about the axis of rotation (D) has an inner region (27) that is open on both sides, through which the rotor winding (12) and the stator winding (14) extend.

4. The inductive rotary transmitter according to claim 1, wherein each stator element (22) has two mutually opposed delimiting faces (32) parallel to one another, which delimit therebetween an air gap (33).

5. The inductive rotary transmitter according to claim 1, wherein each stator element (22) has two interconnected element parts (22*a*, 22*b*).

6. The inductive rotary transmitter according to claim 5, wherein the two element parts (22*a*, 22*b*) are interconnected via connection faces (35) arranged in a connection plane, wherein the connection plane is oriented at right angles to the axis of rotation (D).

7. The inductive rotary transmitter according to claim 4, wherein each stator element (22) has two interconnected element parts (22*a*, 22*b*), each having one of the delimiting faces (32).

8. The inductive rotary transmitter according to claim 1, wherein each stator element (22) has two side faces (24) pointing in a circumferential direction (U) about the axis of rotation (D) and each arranged in a radial plane (E) with respect to the axis of rotation (D).

9. The inductive rotary transmitter according to claim 1, wherein the rotor (11) has a ring (42) or an annular disc (15) and the rotor winding (12) is arranged at one end (16) of the ring (15) or the annular disc (42).

10. The inductive rotary transmitter according to claim 9, wherein the annular disc (15) is oriented at right angles to the axis of rotation (D).

11. The inductive rotary transmitter according to claim 1, wherein the rotor (11) and the rotor winding (12) are assigned a plurality of stators (13), which are each arranged in a circumferential portion (B) about the axis of rotation (D).

12. The inductive rotary transmitter according to claim 5, wherein the two interconnected element parts (22*a*, 22*b*) are not identical.

13. The inductive rotary transmitter according to claim 12, wherein only one of the two interconnected element parts includes an axial protrusion (31).

14. The inductive rotary transmitter according to claim 12, wherein a first of the two interconnected element parts (22*a*) has a rectangular cross-section and an other of the two interconnected element parts (22*b*) has a U-shaped cross-section with limbs of different length.

15. The inductive rotary transmitter according to claim 1, wherein the stator winding (14) extends in a radial direction over a distance between a radial outer limb (29) and an axial protrusion (31) of the stator element (22).

16. The inductive rotary transmitter according to claim 15, wherein only small gaps are present between the rotor winding (12) and the radial outer limb (29) and the axial protrusion (31), such that the rotor winding (12) extends across almost an entire distance between the radial outer limb (29) and the axial protrusion (31).

17. The inductive rotary transmitter according to claim 1, wherein the rotor winding (12) and/or the stator winding (14) have a radial extension that is larger than their axial extensions respectively.

18. The inductive rotary transmitter according to claim 1, wherein the rotor winding (12) and/or the stator winding (14) have a rectangular cross-section.

* * * * *